US009029727B2

(12) United States Patent
Puhalla et al.

(10) Patent No.: US 9,029,727 B2
(45) Date of Patent: May 12, 2015

(54) ARC RUNNERS SUITABLE FOR DC MOLDED CASE CIRCUIT BREAKERS AND RELATED METHODS

(71) Applicant: Eaton Corporation, Cleveland, OH (US)

(72) Inventors: Craig Joseph Puhalla, Moon Township, PA (US); Xin Zhou, Wexford, PA (US); James Patrick Sisley, Baden, PA (US); Lance Gula, Clinton, PA (US); Mark A. Janusek, Bethel Park, PA (US)

(73) Assignee: Eaton Corporation, Cleveland, OH (US)

( * ) Notice: Subject to any disclaimer, the term of this patent is extended or adjusted under 35 U.S.C. 154(b) by 205 days.

(21) Appl. No.: 13/749,360

(22) Filed: Jan. 24, 2013

(65) Prior Publication Data

US 2014/0202990 A1 Jul. 24, 2014

(51) Int. Cl.

| | |
|---|---|
| ***H01H 33/20*** | (2006.01) |
| ***H01H 9/46*** | (2006.01) |
| ***H01H 73/18*** | (2006.01) |
| *H01H 9/34* | (2006.01) |

(52) U.S. Cl.

CPC ..... *H01H 33/20* (2013.01); *H01H 9/345* (2013.01); *H01H 9/46* (2013.01); *H01H 73/18* (2013.01)

(58) Field of Classification Search

USPC ..... 218/40, 148, 155; 335/14, 167

See application file for complete search history.

(56) References Cited

U.S. PATENT DOCUMENTS

| | | | | |
|---|---|---|---|---|
| 4,375,021 | A | | 2/1983 | Pardini et al. |
| 4,970,481 | A | | 11/1990 | Arnold et al. |
| 4,973,805 | A | * | 11/1990 | Paton et al. ..... 218/40 |
| 5,130,504 | A | | 7/1992 | Moldovan et al. |
| 5,214,402 | A | * | 5/1993 | DiVincenzo et al. ..... 335/167 |
| 5,583,328 | A | * | 12/1996 | Mitsuhashi et al. ..... 218/33 |
| 5,608,367 | A | | 3/1997 | Zoller et al. |
| 5,877,467 | A | | 3/1999 | Arnold et al. |
| 5,969,314 | A | * | 10/1999 | Rakus et al. ..... 218/7 |
| 6,232,855 | B1 | * | 5/2001 | Malingowski et al. ..... 335/14 |
| 6,300,586 | B1 | | 10/2001 | Doughty et al. |
| 7,009,132 | B1 | * | 3/2006 | Shea et al. ..... 218/155 |
| 8,222,983 | B2 | | 7/2012 | Zhou et al. |
| 2005/0279734 | A1 | | 12/2005 | Carothers et al. |
| 2012/0145675 | A1 | | 6/2012 | Zhou et al. |

FOREIGN PATENT DOCUMENTS

| | | |
|---|---|---|
| FR | 2959347 | 10/2011 |

OTHER PUBLICATIONS

International Search Report and Written Opinion for corresponding PCT Application No. PCT/US2014/011608, date of mailing Sep. 1, 2014.

(Continued)

*Primary Examiner* — Truc Nguyen

(74) *Attorney, Agent, or Firm* — Myers Bigel Sibley & Sajovec, P.A.

(57) ABSTRACT

Circuit breakers include an arc chamber and an arc chute comprising a plurality of arc plates in the arc chamber. The circuit breakers also include a line conductor assembly with at least one arc runner attached to a line conductor in the arc chamber. The arc runner can extend below but adjacent to a bottom arc plate to thereby guide a respective arc into the arc chute.

22 Claims, 12 Drawing Sheets

(56) References Cited

OTHER PUBLICATIONS

Product Details, Molded case circuit breakers (MCCB) for DC Breaker Service, Eaton Corporation, 1 pages, http://www.eaton.com/Eaton/ProductsServices/Electrical/Productsan . . . , date unkown, printed from the internet Oct. 26, 2012.

Invitation to pay additional fees for corresponding PCT application No. PCT/US2014/011608, date of mailing Apr. 22, 2014.

* cited by examiner

ARC RUNNERS SUITABLE FOR DC MOLDED CASE CIRCUIT BREAKERS AND RELATED METHODS

FIELD OF THE INVENTION

The present invention relates to arc runners used with circuit breakers.

BACKGROUND OF THE INVENTION

Circuit breakers are one of a variety of overcurrent protection devices used for circuit protection and isolation. The circuit breaker provides electrical protection whenever an electric abnormality occurs. In a circuit breaker, current enters the system from a power line and passes through a line conductor to a stationary contact fixed on the line conductor, then to a movable contact. The movable contact can be fixedly attached to an arm and the arm can be mounted to a rotor. As long as the stationary and movable contacts are in physical contact, current passes from the stationary contact to the movable contact and out of the circuit breaker to down line electrical devices.

In the event of an overcurrent condition (e.g., a short circuit), extremely high electromagnetic forces can be generated. The electromagnetic forces repel the movable contact away from the stationary contact. Because the movable contact is fixedly attached to a rotating arm, the arm pivots and physically separates the stationary and movable contacts thus tripping the circuit. Upon separation of the contacts and blowing open the circuit, an arcing condition occurs. The breaker's trip unit will trip the breaker which will cause the contacts to separate. Also, arcing occurs during normal "ON/OFF" operations on the breaker. It is desirable to suppress resultant arcs.

A typical method of suppressing the arc is to direct it into an arc chute, which is generally a series of metal plates that dissipate the energy of the arc. This arc chute is situated proximate to the stationary contact point of the circuit. An arc runner is used to direct the arc to the arc chute. The arc runner covers the exposed area of the line conductor. Since the arc runner provides a pathway for the arc to follow to the arc chute, it is subject to intensely high temperatures.

During higher fault interruptions, particularly those associated with DC currents, the arc can be resistant to movement into the arc chute because the magnetic field created by the permanent magnets in the arc chute may not be sufficiently strong against the gas dynamic force to push and stretch the arc into lower arc plates. The lack of engagement between the arc and the lower arc plates may cause longer arcing time and damage to the arc chute and breaker.

SUMMARY OF EMBODIMENTS OF THE INVENTION

Embodiments of the present invention are directed to arc runners that can reduce arcing time and/or inhibit damage to the arc chute and/or breaker.

Some embodiments are directed to bi-directional direct current (DC) circuit breakers.

Some embodiments are directed to circuit breakers that include: (a) an arc chamber; (b) an arc chute comprising a plurality of arc plates in the arc chamber; (c) a line conductor in the arc chamber, the line conductor having a lower body portion and an upwardly extending arm with a free end, the arm residing above the lower body portion; (d) a stationary contact held by the arm of the line conductor, the stationary contact residing adjacent to the arc plates; and (e) a non-ferromagnetic arc runner held by the line conductor in the arc chamber. The arc runner is at least one of (i) attached to the lower body portion of the line conductor and resides forward of the stationary contact with a portion residing under a bottom arc plate or (ii) attached to the arm of the line conductor and resides at least partially on a substantially common plane as the stationary contact with at least one downwardly extending sidewall that extends down toward the lower body portion of the line conductor a distance forward of the stationary contact with a portion residing under a bottom arc plate, whereby the arc runner defines an arc path that leads to the underside of one or more of the lower arc plates.

The arc runner can have forward facing spaced apart segments defining a gap space therebetween.

The arc runner can have a pair of spaced apart fingers that are planar and substantially horizontally oriented.

The arc runner can have a pair of spaced apart substantially vertically extending sidewalls.

The circuit breaker can include a non-conductive line conductor cover residing over an upper surface of the lower portion of the line conductor.

The arc runner can be attached to the lower body portion and can have curved shape with upper and lower substantially parallel segments. The upper segment can have a free end that faces the arc plates and resides a distance under the arm of the line conductor. The lower segment can reside adjacent the lower body portion of the line conductor and spaced apart below the line conductor arm.

The arc runner can be attached to the lower body portion and can have a body with legs that rise up to a location above or proximate the arm of the line conductor proximate the stationary conductor, then travel down to a forward planar segment that resides under the bottom arc plate.

The circuit breaker can include a line conductor cover with a lower wall that merges into an upper arm that tapers upward to a free end that terminates before the stationary conductor. The line conductor cover can include a laterally extending slot sized and configured to slidably receive the arm of the line conductor so that the line conductor arm resides under the line conductor cover arm and the lower portion of the line conductor cover resides above the line conductor lower body portion.

The arc runner can be an auxiliary arc runner and the circuit breaker can also include a stationary arc runner that resides in front of the stationary conductor on the arm of the line conductor.

The arc runner can be attached to the line conductor arm and can have two spaced apart downwardly extending walls, one residing on each side of the arm and extending a distance forward of the stationary contact.

The circuit breaker can include a reverse loop cover residing on the arm of the line conductor spaced apart from the stationary contact and away from the free end of the line conductor.

The arc runner can be an auxiliary arc runner that is attached to the line conductor arm and the circuit breaker can include a stationary arc runner that resides in front of the stationary conductor on the arm of the line conductor and a line conductor cover residing on the lower body portion of the line conductor. The auxiliary arc runner can have two spaced apart downwardly extending walls with lower ends residing above the line conductor lower body with a gap space therebetween, one wall residing on each side of the line conductor arm with outwardly extending narrow fingers on the forward ends thereof.

The circuit breaker can include a line conductor cover residing on the lower body portion of the line conductor. The arc runner can have two spaced apart downwardly extending walls with lower edges residing proximate the line conductor cover, one residing on each side of the line conductor arm with outwardly extending downwardly and outwardly extending substantially planar fingers on the forward ends.

The arc runner can have a forward end portion with fingers having a gap space therebetween that reside a one on each side of the stationary contact.

The gap space has a width that is greater than a width of the stationary contact and/or adjacent arc plate.

The circuit breaker can include a line conductor cover residing on the lower body portion of the line conductor. The arc runner, line conductor and line conductor cover each can include at least one aligned aperture that receives an attachment member that attaches the arc runner to the line conductor.

Yet other embodiments are directed to an arc chamber assembly. The assembly includes: an arc chamber having a molded body; an arc chute including a plurality of arc plates in the arc chamber; a movable arm holding a movable contact in the arc chamber; and a line conductor assembly with a line conductor having a lower body portion and an upwardly extending arm with a free end, the arm residing above the lower body portion. The line conductor assembly includes a stationary contact that cooperates with the movable contact and a non-ferromagnetic arc runner attached to the line conductor residing in the arc chamber. The arc runner is at least one of (a) attached to the lower body portion of the line conductor and resides forward of the stationary contact with a portion residing under a bottom arc plate or (b) attached to the arm of the line conductor and resides on a substantially common plane as the stationary contact with at least one downwardly extending sidewall that extends down toward the lower body portion of the line conductor a distance forward of the stationary contact with a portion residing under a bottom arc plate. The arc runner defines an arc path that leads to the underside of one or more of the lower arc plates. The arc chamber assembly also includes a non-conductive line conductor cover residing over the line conductor lower body portion.

Still other embodiments are directed to arc runner assemblies. The assemblies include: an elongate line conductor having a lower body portion and an upwardly extending arm, the line conductor holding a stationary electrical contact on a forward end portion of the arm for a direct current (DC) circuit breaker; a non-ferromagnetic arc runner attached to the elongate line conductor, wherein the arc runner has forward extending segments that define a gap space therebetween, the segments sized and configured to reside on opposing lateral sides of the line conductor arm and/or stationary contact; and a non-conductive line conductor cover residing over the line conductor lower body portion.

The spaced apart segments can be fingers that extend down from the line conductor arm or that extend up from the lower body portion of the line conductor and face the arc plates.

The spaced apart segments can be upper portions of legs that rise up from the lower body portion of the line conductor then travel down toward a front planar end of the arc runner.

The arc runner can be a first arc runner and the assembly can include a second arc runner that is held by the arm of the line conductor.

Still other embodiments are directed to methods of directing arcs in an arc chute of a circuit breaker. The methods include: (a) providing a circuit breaker with an arc chamber comprising an arc chute with arc plates and a line conductor with a stationary conductor and least one arc runner; and (b) directing an electrical arc to travel along an arc path that extends to an underside of a bottom arc plate of the arc chute using the arc runner.

Further features, advantages and details of the present invention will be appreciated by those of ordinary skill in the art from a reading of the figures and the detailed description of the preferred embodiments that follow, such description being merely illustrative of the present invention.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

DETAILED DESCRIPTION OF EMBODIMENTS OF THE INVENTION

Figure 2A:
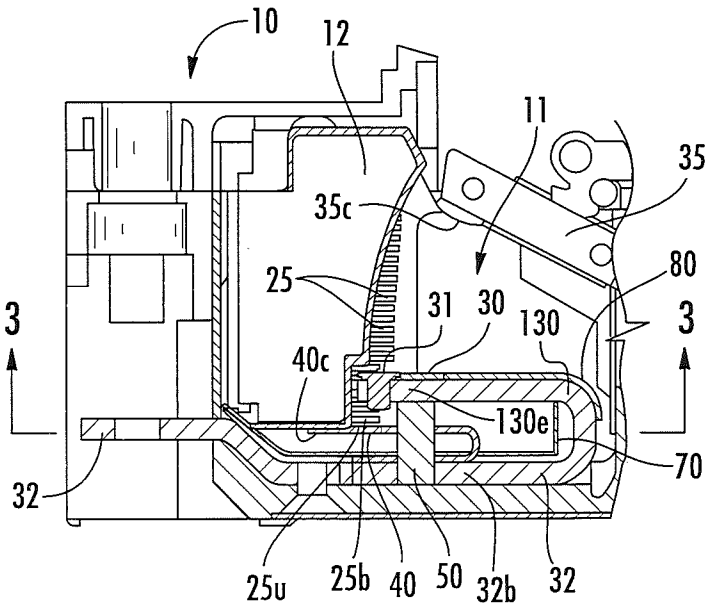
FIG. 2A is a side section view thereof.

The present invention now will be described more fully hereinafter with reference to the accompanying drawings, in which illustrative embodiments of the invention are shown. Like numbers refer to like elements and different embodiments of like elements can be designated using a different number of superscript indicator apostrophes (e.g., 40, 40', 40", 40''').

In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90° or at other orientations) and the spatially relative descriptors used herein interpreted accordingly. The term "about" refers to numbers in a range of +/−20% of the noted value.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

The term "auxiliary arc runner" refers to an arc runner that is used with another arc runner and is configured to encourage an electrical arc to travel from a position above the bottom arc plate to a location underneath a lower positioned arc plate, typically underneath a bottom arc plate to make the lower or bottom arc plate more involved in arc interruption relative to conventional arc runner configurations.

The term "non-ferromagnetic" means that the noted component is substantially free of ferromagnetic materials so as to be suitable for use in the arc chamber (non-disruptive to the magnetic circuit) as will be known to those of skill in the art.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

Turning now to the figures, FIGS. 1, 2A-2C and 3, illustrate a circuit breaker 10 with at least one arc chamber 11 having an arc chute 12 with arc plates 25, a line conductor assembly 45 comprising a stationary contact 30 and at least one arc runner 40. The arc plates 25 can be stacked with top, medial and lower or bottom arc plates 25*t*, 25*i* and 251, respectively, typically configured as closely spaced plates as shown. The line conductor assembly 45 can also include a line conductor 32. The line conductor assembly 45 may also include a line conductor cover 70.

Figure 1:
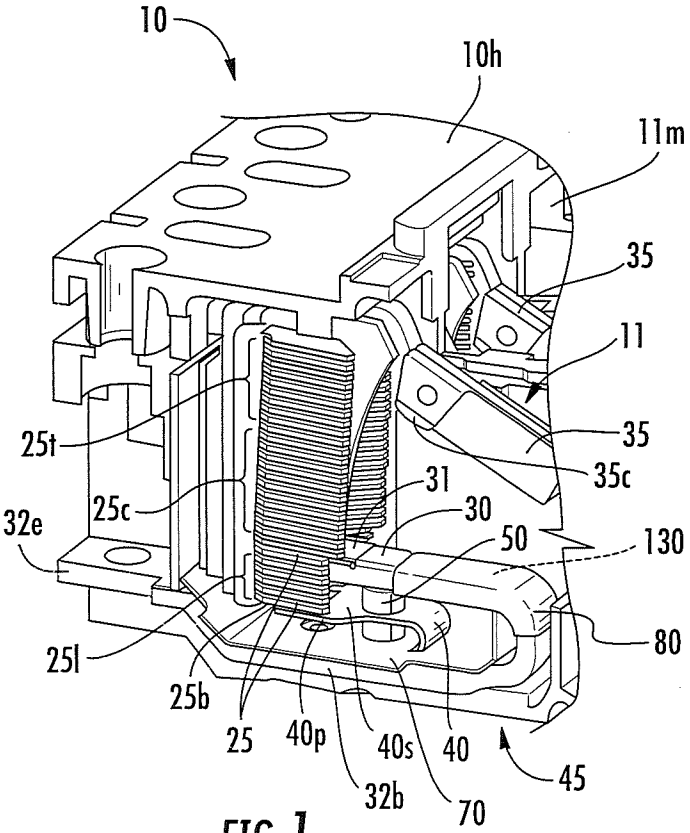
FIG. 1 is a side perspective, partial cutaway view of an exemplary circuit breaker according to embodiments of the present invention.
Figure 2C:
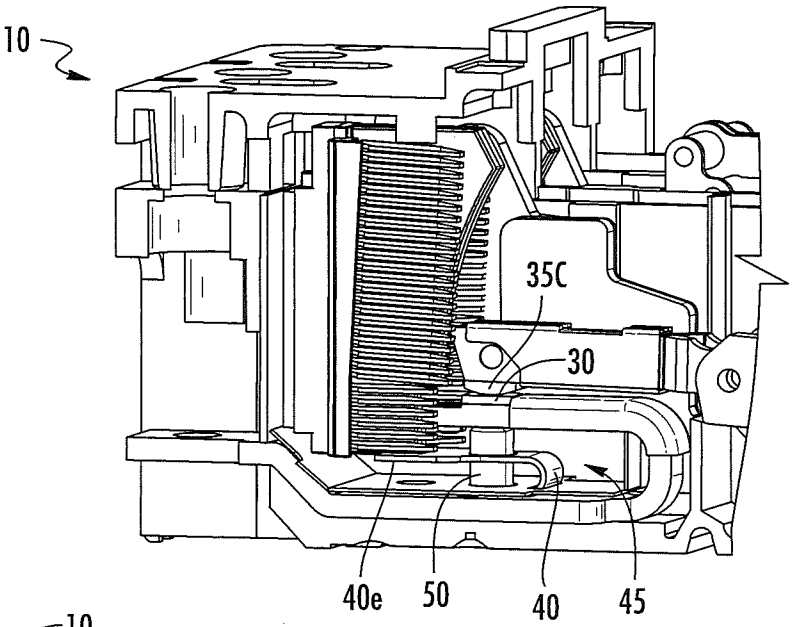
FIG. 2C is a side perspective view thereof.
Figure 2B:
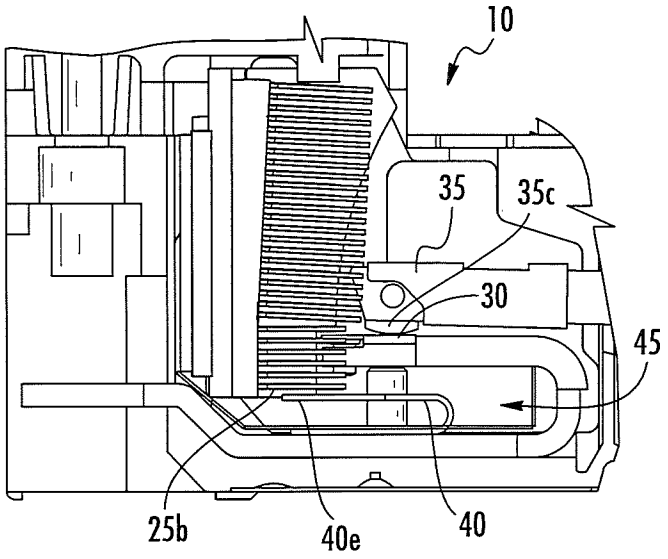
FIG. 2B is a side view of the circuit breaker shown in FIG. 1.
Figure 3:
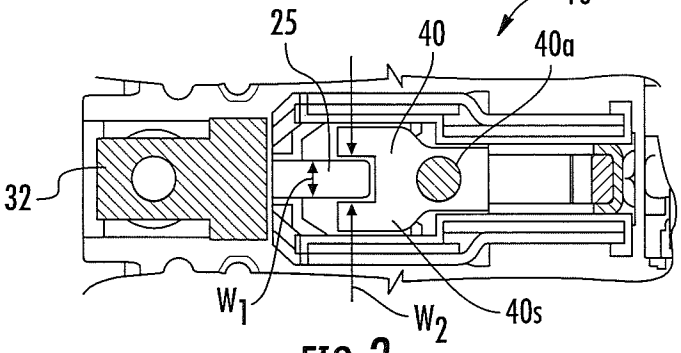
FIG. 3 is a section view taken along line 3-3 of FIG. 2A.
Figure 4A:
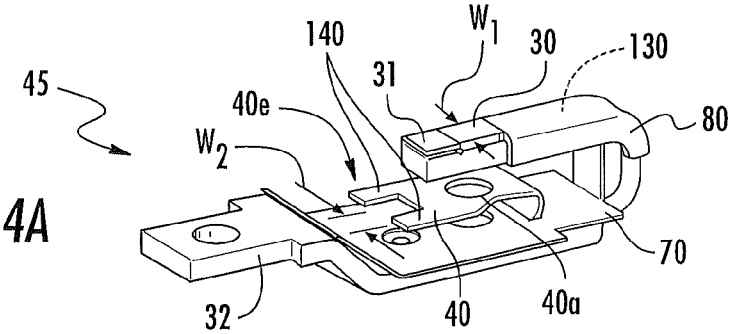
FIG. 4A is a side perspective view of an exemplary line conductor assembly according to embodiments of the present invention.
Figure 4B:
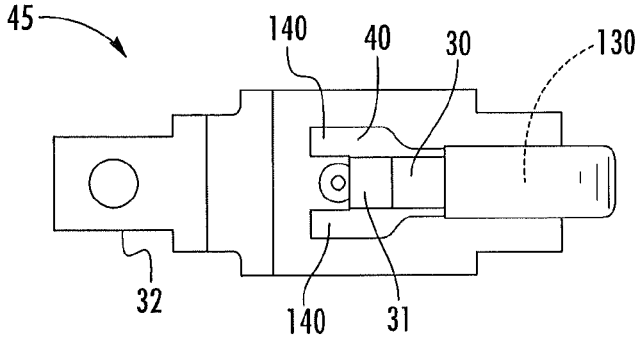
FIG. 4B is a top view thereof.
Figure 4C:
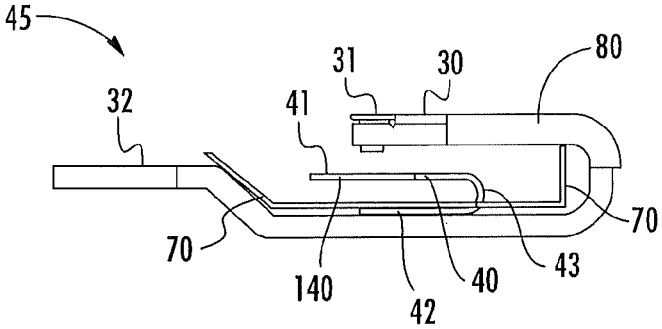
FIG. 4C is a side view thereof.
Figure 4D:
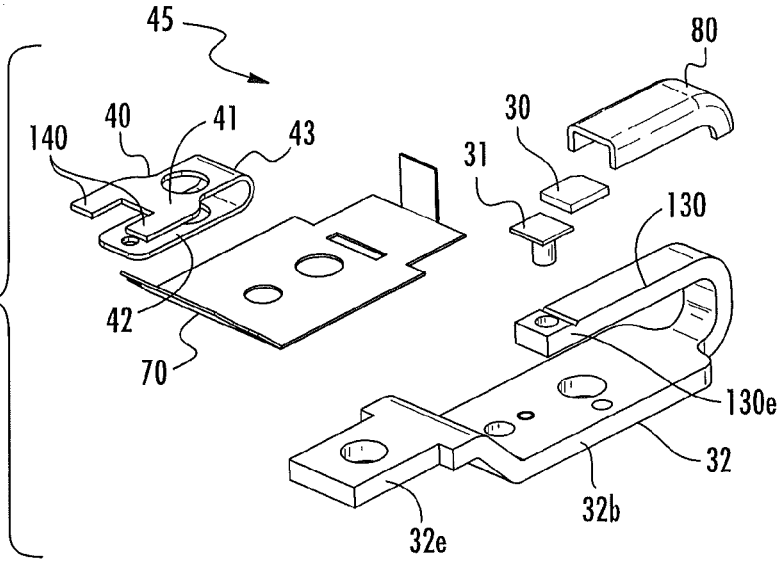
FIG. 4D is an exploded view thereof.

Referring to FIGS. 4A-4D, in some embodiments, the line conductor 32 can include a primary body portion 32*b* with an upwardly curved arm 130 that has a free end 130*e* that faces the arc plates 25. The primary body portion 32*b* can have a free end 32*e* that resides below the arm free end 130*e* and extends past the arc plates 25 as shown in FIG. 1, for example. The line conductor assembly 45 can also optionally include a reverse loop cover 80 that resides behind the stationary contact 30 on the arm 130.

FIG. 1 shows that the circuit breaker 10 can include multiple adjacent arc chambers 11*m*. However, the circuit breaker 10 can alternatively include a single chamber 11 design.

The term "lower arc plate" refers to an arc plate 25 residing below the movable (rotating) arm 35 that holds a movable contact 35*c*, when deployed to reside proximate the stationary contact 30, and/or that resides below or in a common plane as the stationary contact 30.

As will be discussed further below, the figures illustrate four exemplary configurations of a line conductor assembly 45 although other configurations may also be used. The respective assemblies 45 include at least one arc runner 40, 40', 40", 40''' respectively. The arc runner 40, 40', 40", 40''' can define a current pathway to allow an arc to engage one or more of the lower arc plates 251 thereby reducing arcing time. At least a portion of a respective arc runner 40, 40', 40", 40''' can reside proximate one or more of the lowest three (3), lowest two (2) and/or a bottom arc plate 25*b* of the circuit breaker in the orientation shown in FIGS. 1, 7A, 9A and 9B.

The at least one arc runner 40, 40', 40", 40''' can be positioned to have a portion that resides proximate and under the bottom arc plate 25*b* as shown, for example, in FIGS. 1, 6A, 7A and 9A. The arc runner 40, 40', 40", 40''' can be spaced apart from the adjacent arc plate 25 so that an air gap resides between the respective arc runner 40, 40', 40", 40''' and one or more adjacent plate 25 (both side to side and above) as shown, for example, in FIGS. 2B, 2C, 3, 6A, 7B, 7E and 9B.

In the embodiment shown with respect to FIGS. 1, 2A-2C-3, 4A-4D and the embodiment shown with respect to 5A-5D and 6A, 6B, the arc runner 40, 40' respectively, can be an auxiliary arc runner 40, 40' that can be held with an upper arc runner 31 by a respective line conductor 32. In the embodiment shown in FIGS. 8A-8D and the embodiment shown in FIGS. 10A-10D, for example, the respective arc runner 40", 40''' can be the only arc runner held by a respective line conductor 32 and the single arc runner 40", 40''' can be configured to perform the functions of both arc runners of the prior embodiments.

The arc runner 40, 40', 40", 40''' can be held by, typically attached to, the line conductor 32. The arc runner 40, 40', 40", 40''' can be located to have at least a portion that resides in front of the stationary contact 30 and can have portions that can be located at (substantially) the same plane or below the stationary contact 30. The arc runner 40, 40', 40", 40''' can have a forward end 40*e* that resides closely spaced apart and below a bottom arc plate 25*b*.

The electrical path 40*p* of the arc runner 40, 40', 40", 40''' can lead to an underside 25*u* of the bottom arc plate 25*b* as shown, for example, in FIGS. 2A-2C, 6A, 6B, 7B, 7C and 9A.

The arc runner 40, 40', 40", 40''' can be formed as a monolithic single or unitary body of a non-ferromagnetic material such as stainless steel, copper, and the like. In other embodiments, the runner 40, 40', 40", 40''' can be a multiple component device of one or different non-ferromagnetic materials.

In some particular embodiments, the circuit breaker 10 can be a bi-directional direct current (DC) molded case circuit breaker (MCCB). See, e.g., U.S. Pat. Nos. 5,131,504 and 8,222,983, the contents of which are hereby incorporated by reference as if recited in full herein. The DC MCCBs can be suitable for many uses such as data center, photovoltaic, and electric vehicles applications. The circuit breakers 10 can be rated for voltages between about 1 V to about 5000 volts (V) DC and/or may have current ratings from about 15 to about 2,500 Amperes (A). However, it is contemplated that the circuit breakers 10 and components thereof can be used for any voltage, current ranges and are not limited to any particular application as the circuit breakers can be used for a broad range of different uses.

In some embodiments, the circuit breakers 10 can be suitable as AC circuit breakers or both AC and DC circuit breakers.

As is known to those of skill in the art, Eaton Corp. has introduced a line of molded case circuit breakers (MCCBs) designed for commercial and utility scale photovoltaic (PV) systems. Used in solar combiner and inverter applications, Eaton PVGard™ circuit breakers are rated up to 600 amp at 1000 Vdc and can meet or exceed industry standards such as UL 489B, which requires rigorous testing to verify circuit protection that meets the specific requirements of PV systems. However, it is contemplated that the circuit breakers 10 can be used for various applications with corresponding voltage capacity/rating.

The arc runner 40, 40', 40", 40''' can be configured to allow a respective arc to move away from the forward surface 40*s* and onto one, both and/or either lateral side of the stationary contact 30 depending on the DC current direction, typically on one side of the contact 30 (right or left). The arc runner 40, 40', 40", 40''' can have a forward surface 40*e* that resides proximate to and below the bottom arc plate 25*b* so to guide the arc into the arc chute 12.

FIGS. 4A-4D show a line conductor assembly 45 with the arc runner 40 configuration shown in FIGS. 1, 2A-2C and 3 outside the (molded) circuit breaker housing 10*h*.

FIGS. 5A-5D, 6A and 6B show a second exemplary configuration of the line conductor assembly 45 with another embodiment of the arc runner 40'. As shown, the arc runner 40' resides under the arm 130 of the line conductor 32 and/or stationary contact 30, with downwardly extending sidewalls extending below the arc runner 31. The arc runner 40' has two spaced apart downwardly extending walls 40*w*, one residing on each side of the arm 130. The walls 40*w* can have narrow fingers 140 on the forward ends that extend outwardly to reside under a bottom arc plate 25*b*. The term "narrow" means that the noted arc runner feature is between about 5-40%, typically between about 10-25%, of the length (or height) dimension of the adjacent body of the arc runner wall 40*w*.

FIGS. 7A-7E and 8A-8D show a third exemplary configuration of the line conductor assembly 45 with another embodiment of the arc runner 40". As shown in this embodiment, the arc runner 40" can reside on top of the arm 130 of the line conductor 32.

FIGS. 9A, 9B and 10A-10D show a line conductor assembly 45 with a fourth exemplary configuration of the arc runner 40'''.

Figure 5A:
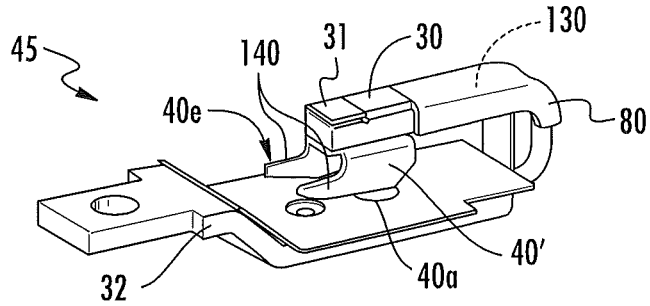
FIG. 5A is a side perspective view of another exemplary line conductor assembly according to embodiments of the present invention.
Figure 5B:
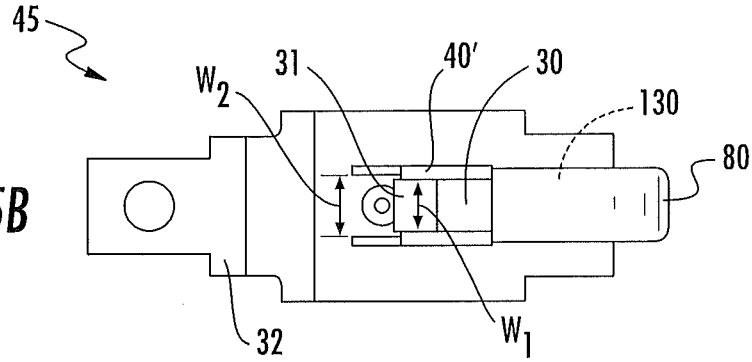
FIG. 5B is a top view thereof.
Figure 5C:
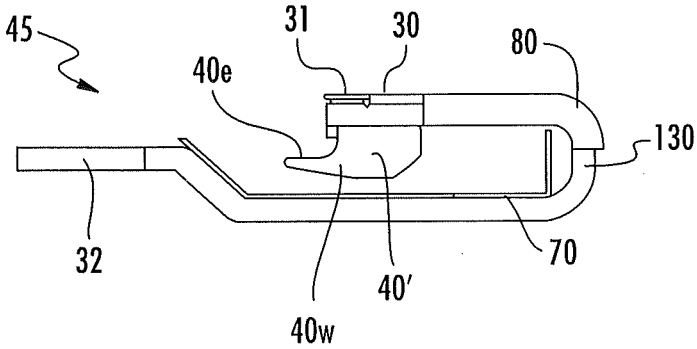
FIG. 5C is a side view thereof.
Figure 5D:
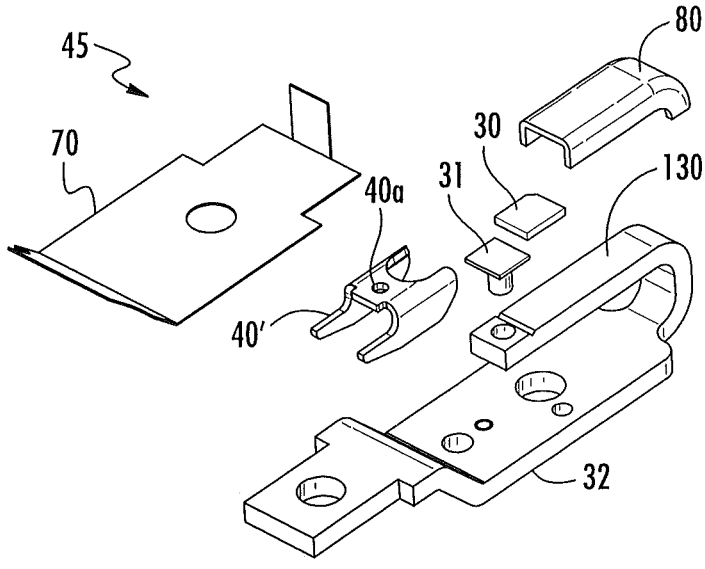
FIG. 5D is an exploded view thereof.
Figure 6B:
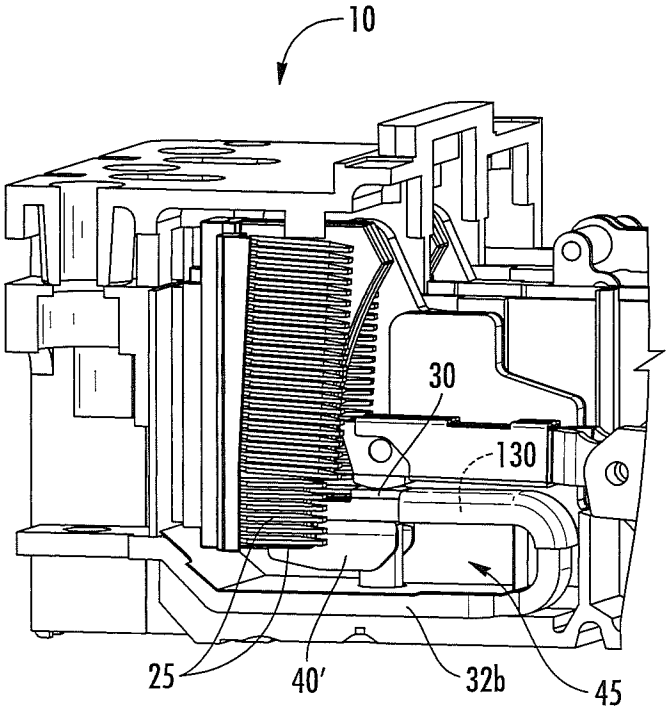
FIG. 6B is a side perspective view of the circuit breaker with the line conductor assembly shown in FIG. 6A.
Figure 6A:
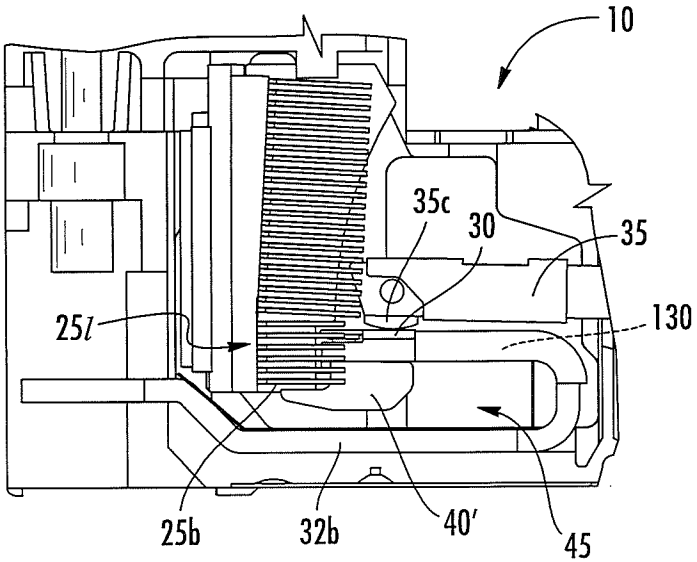
FIG. 6A is a side perspective view of the circuit breaker with the line conductor assembly shown in FIG. 5A according to embodiments of the invention.
Figure 8A:
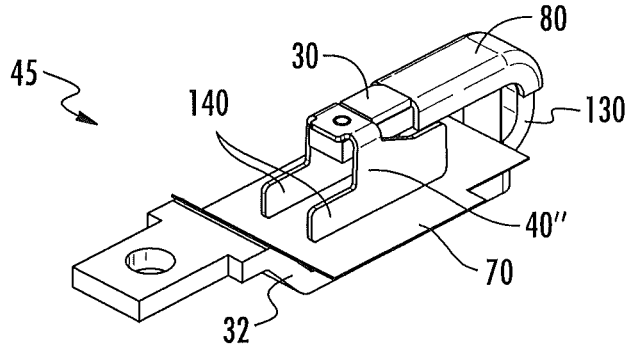
FIG. 8A is a side perspective view of the line conductor assembly shown in an exemplary circuit breaker in FIGS. 7A-7E.
Figure 8B:
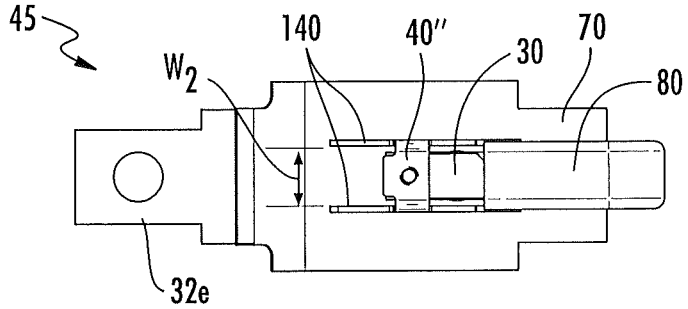
FIG. 8B is a top view thereof.
Figure 10A:
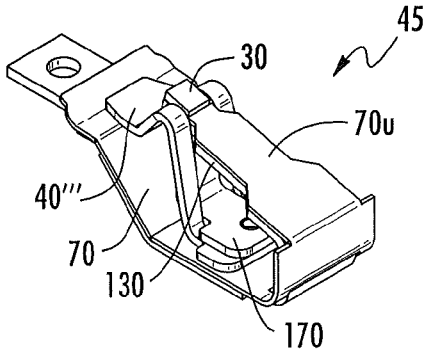
FIG. 10A is a side perspective view of the exemplary line conductor assembly shown in the circuit breaker of FIG. 9A according to embodiments of the present invention.
Figure 10B:
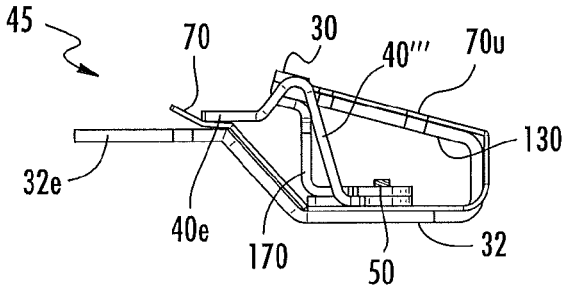
FIG. 10B is a top view thereof.
Figure 10C:
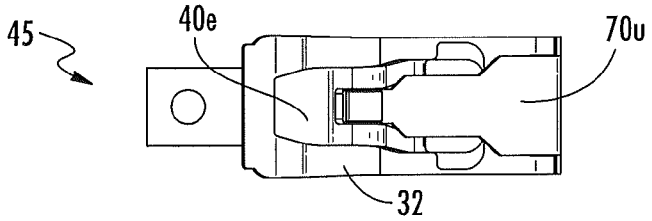
FIG. 10C is a side view thereof.
Figure 10D:
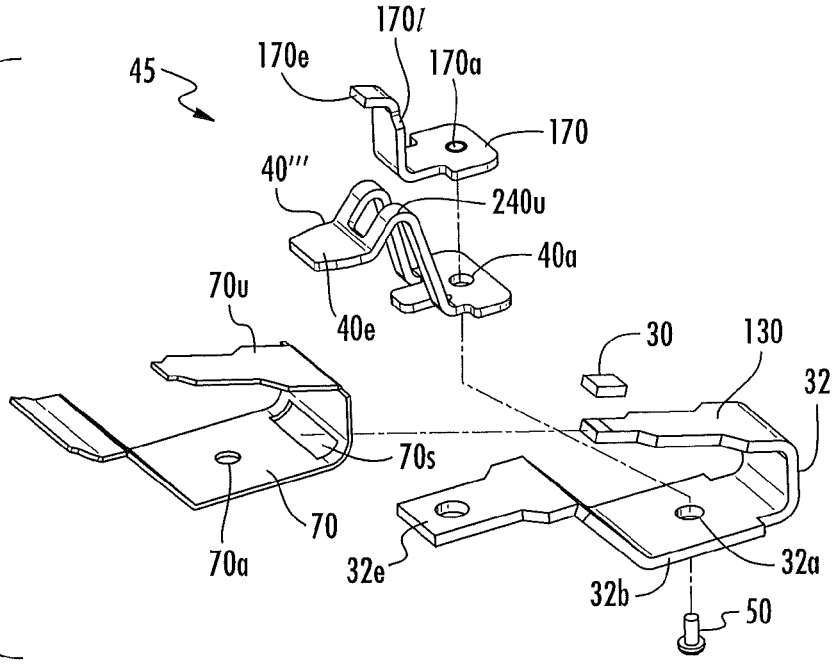
FIG. 10D is an exploded view thereof.
Figure 10E:
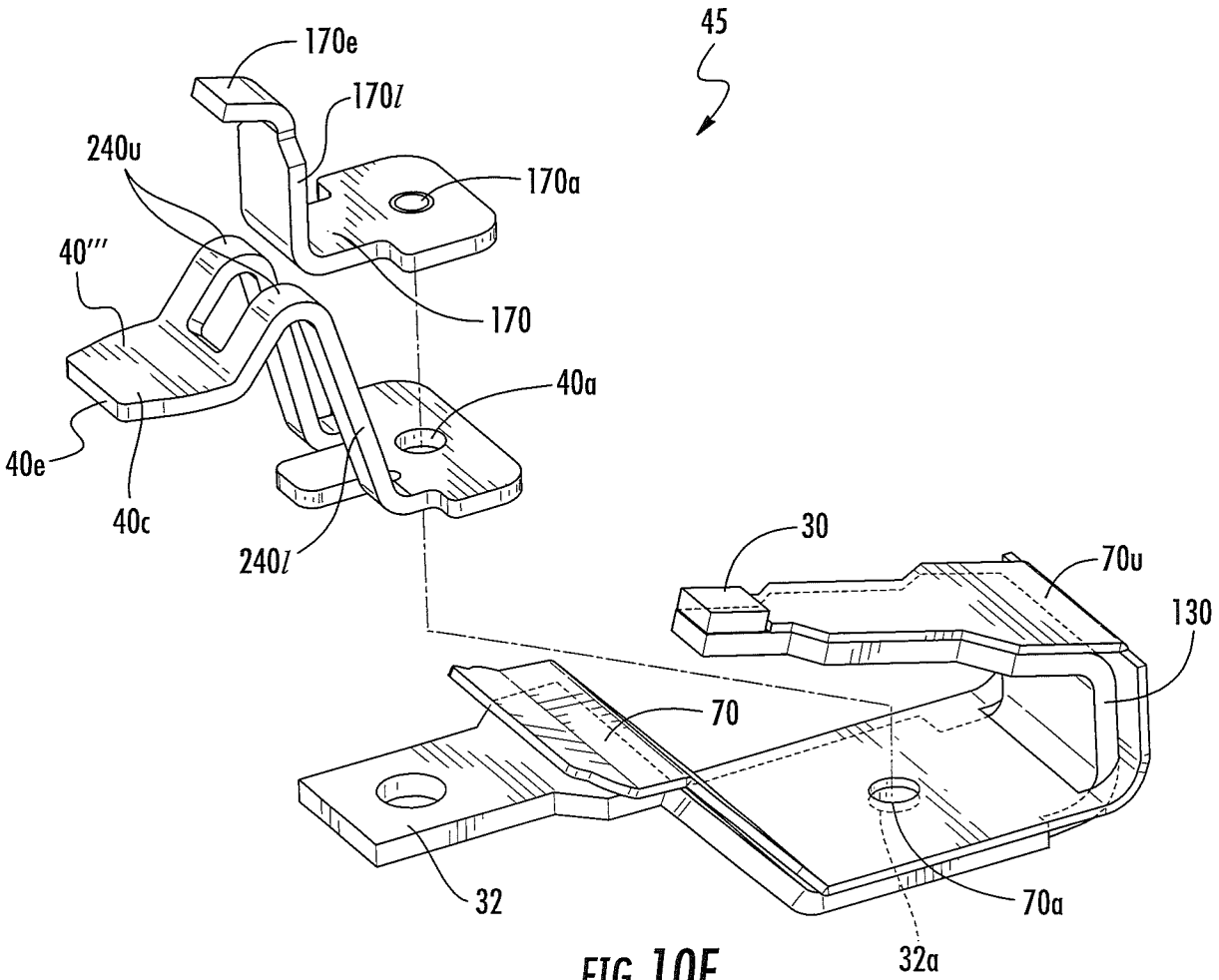
FIG. 10E is a partial assembly view thereof.

As noted above, in the third and fourth embodiments shown in FIGS. 8A, 10A, the upper arc runner 31 shown in FIGS. 1 and 5A, for example, is not required.

The arc runner 40, 40', 40", 40''' can have an upper portion with spaced apart fingers 140 that face (and reside) adjacent the stack 25. As shown in FIGS. 3, 4A, 5B, 7E and 8A the fingers 140 or legs 240 (FIG. 10D) can have a gap space with a width W2 that is the greater than a width W1 (typically greater by between about 1% to about 31% of the width W1) of the arc plate 25 and/or the contact 30. The gap space can be an air gap or may be filled or partially filled with an insulator material which may be compressible (e.g., a flexible elastomer). In some embodiments, as shown in FIGS. 3, 4A, 5A, 7B, 8D, for example, the fingers 140 can be spaced apart over their entire length. In other embodiments, the fingers 140, where used, can be attached together on a leading end portion via conductive or non-conductive material.

As shown in FIGS. 10A-10D, for example, the leading end 40*e* (the end facing the stack 25) has a continuous, conductive, non-ferromagnetic substantially planar configuration. In other embodiments, the front end 40*e* can have interleaved conductive and non-conductive and/or air gap portions (not shown).

In some embodiments, as shown in FIGS. 4A-4D, for example, the arc runner 40 can have a "turn-back" configuration so that the magnetic field generated by the DC current will help to drive the arc along the arc runner surface 40*s* and into the arc chute 12. The end of a respective arc runner 40*e* facing the plates 25 can be a free end while the opposing end can include the upwardly extending attachment segment. The arc runner 40 "turn-back" configuration can be shaped with a first linear segment 41 and an upper or lower second substantially co-planar segment 42 with an intermediate upwardly or downwardly extending curved and/or bent segment 43 connecting the two substantially co-planar segments 41, 42. The upwardly extending segment 43 can reside under, and spaced apart from, the stationary arc runner 31. As also shown, the arc runner contact surface 40*s* can be substantially planar and horizontally oriented with the fingers 140 extending forward of the contact 30.

FIGS. 5A-5D, 6A and 6B show the arc runner 40' with the fingers 140 extending down from and forward from the arc runner 31. The fingers 140 can have sidewalls 40*w* that are orthogonal to the stationary contact 30. As shown, the fingers 140 can taper upward at the forward most end 40*e* thereof (the end facing the stack 25).

FIGS. 7A-7E and 8A-8D illustrate a circuit breaker 10 with an arc runner 40" that is similar to that shown in FIGS. 5A-5D. As shown, the forward end portion 40*e* has lower and upper edges 140*u*, 140*l* that are substantially planar, e.g., straight rather than curved as shown in FIG. 5A, for example. As shown, no other arc runner (e.g., arc runner 31) is held by the line conductor 32. The arc runner 40" can span across the upper surface of the line conductor 32 (over the arm 130) forward of the stationary conductor 30 and outwardly from the forward end of the arm 130. The arc runner 40" can have downwardly extending planar walls 40*w*.

FIGS. 9A, 9B and 10A-10E illustrate that the arc runner 40''' can be configured to extend up from a base body portion 32*b* of the line conductor 32. The arc runner 40''' can include an upper portion 240*u* that has an open gap space with segments that reside on either side of the stationary contact 30. As shown, the line conductor assembly 45 can include a line conductor support 170 that attaches to the arc runner 40''' and the line conductor body portion 32*b*. The assembly 45 can also include a line conductor cover 70 with a slot 70*s*. The line conductor arm 130 can extend through this slot 70*s* to reside under (closely spaced apart or abutting) the underside of the upper arm 70*u* of the line conductor cover 70 when assembled. The arc runner 40''', the line conductor cover 70, the line conductor 32 and the line conductor support 170 can each include respective apertures 40*a*, 70*a*, 32*a*, 170*a* that align to receive an attachment member 50. In other embodiments, one or more of the cooperating members can be attached via adhesive, brazing, welding, snap fit, frictional engagement or other suitable attachment configurations.

As also shown, the line conductor support 170 and arc runner 40''' can include a respective leg 240*l*, 170*l*, that rises above the line conductor 32 and each can include a free forward end 40*e*, 170*e*. The free end of the line conductor support 170*e* can abut and reside beneath the free end of the arc runner 40*e*.

Referring to FIGS. 10A-10E, the upper portion of the legs 240*l* can extend above the contact 30 and reside at a level corresponding to the position on either side of the contact 30. The legs 240*l* can travel up from the body portion 32*b* of the line conductor 32 to a peak region proximate the contact 30, then travel down in the direction of the stack 25.

As noted above, the arc runner 40, 40', 40", 40" is typically made of non-ferromagnetic conductive (e.g., metal) material. The arc runner 40, 40', 40", 40''' can be attached to the line conductor 32 via any suitable attachment means, including, one or combinations of, screws, pins, welding, brazing, adhesives, snap-fit features, bayonet features, frictional engagement and/or matable features and the like.

As shown in FIGS. 1, 2, 6A, 7D, 9A and 10D, for example, the arc runner 40, 40', 40", 40''' can be attached to the line conductor 32 with an attachment member 50. The respective arc runner 40, 40', 40", 40''' can include a slot or aperture 40*a* (FIGS. 3, 4A, 5D, 7B, 8D, 10D) that allows the attachment member, such as screw 50, to extend therethrough. In other embodiments, the arc runner 40, 40', 40", 40''' can include a protrusion, ridge or lip that is matably received into a cooperating feature such as a recess or aperture in the line conductor 32 thus not requiring a separate attachment member. The reverse configurations may also be used.

In some embodiments, a respective arc runner may optionally be attached to both the line conductor lower body portion 32*b* and the arm 130.

Figure 7B:
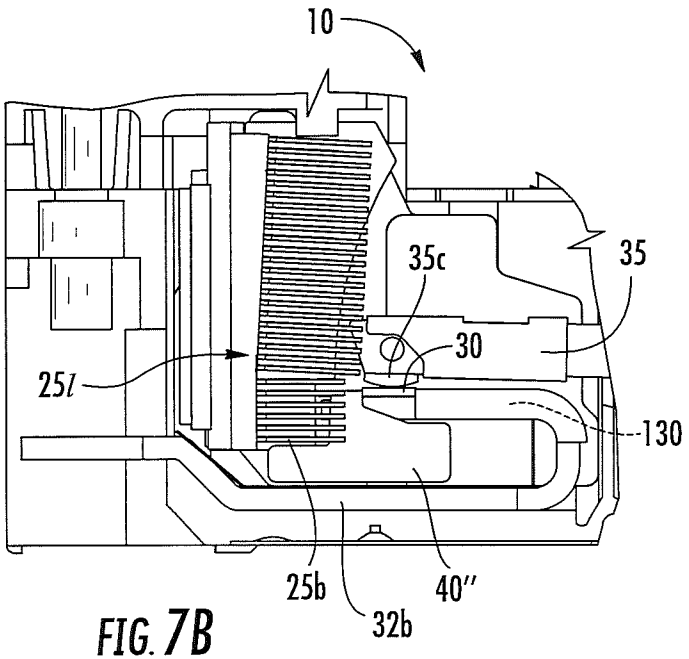
FIG. 7B is a side view thereof.
Figure 7A:
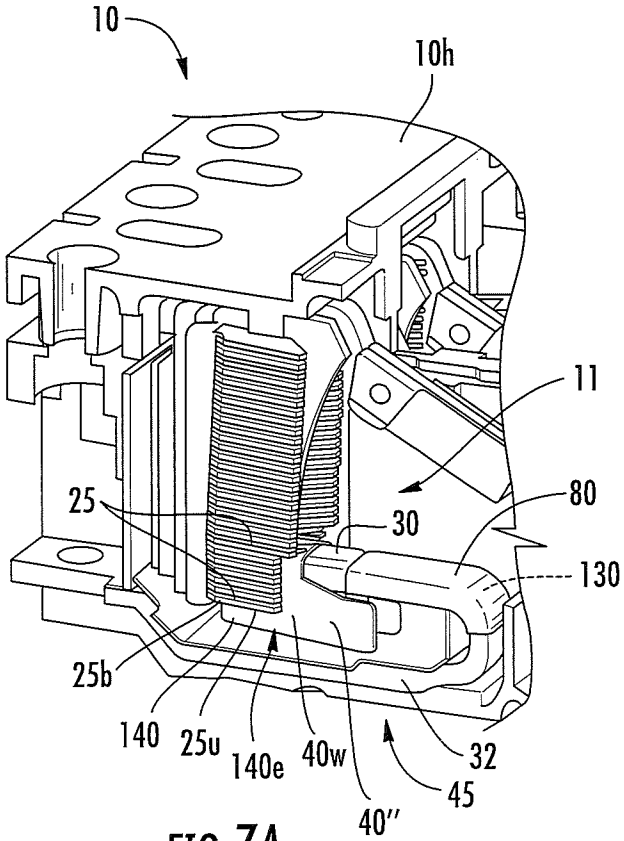
FIG. 7A is a side perspective, partial cutaway view of a circuit breaker with another exemplary line conductor assembly according to embodiments of the present invention.
Figure 7D:
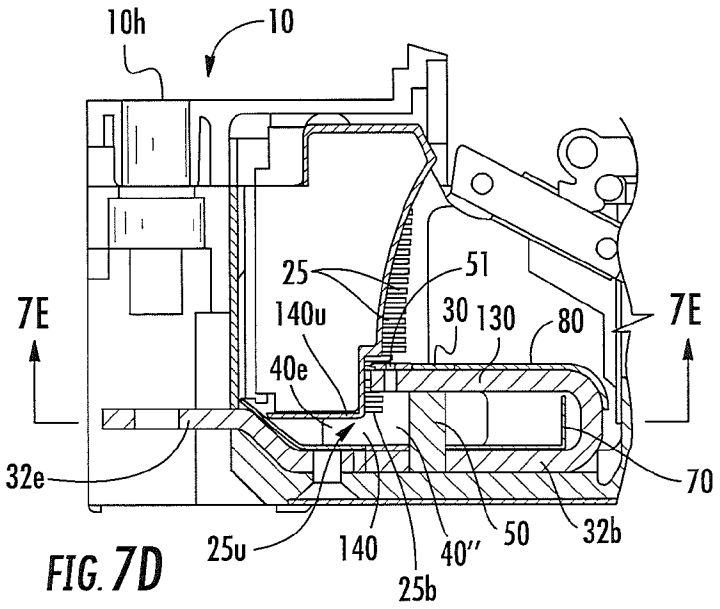
FIG. 7D is a side section view of the circuit breaker shown in FIG. 7A.
Figure 7E:
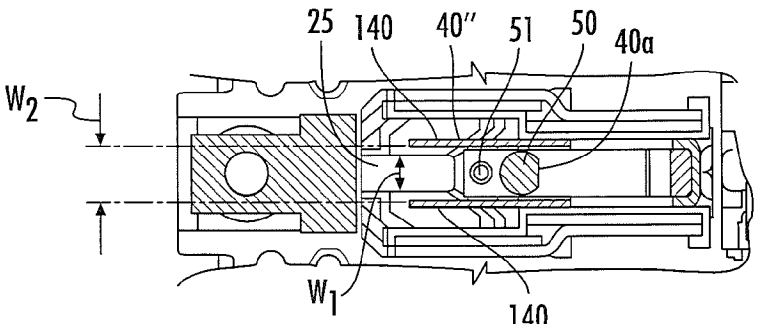
FIG. 7E is a top view thereof taken along lines 7E-7E of FIG. 7D.
Figure 7C:
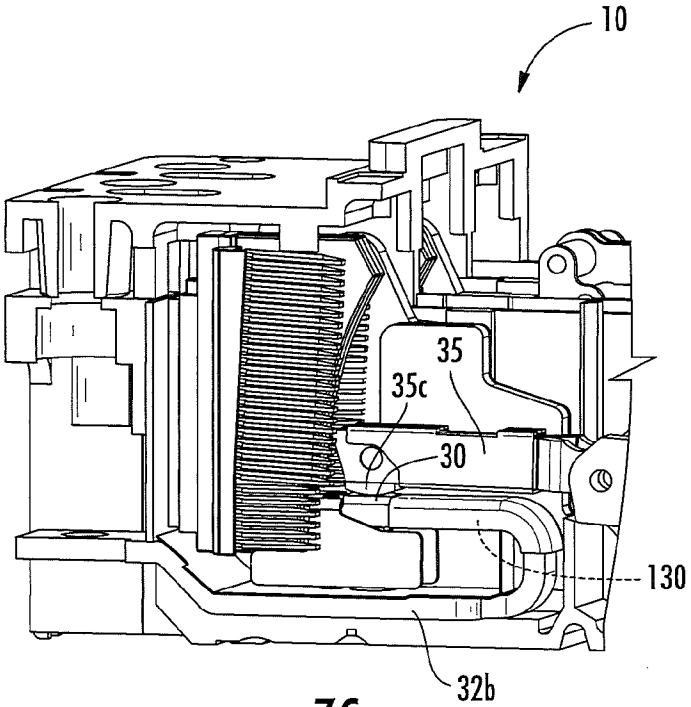
FIG. 7C is a side perspective view thereof.
Figure 8C:
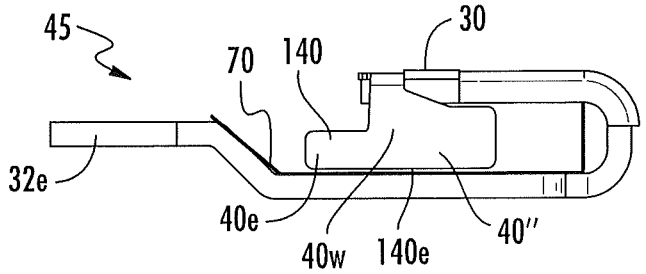
FIG. 8C is a side view thereof.
Figure 8D:
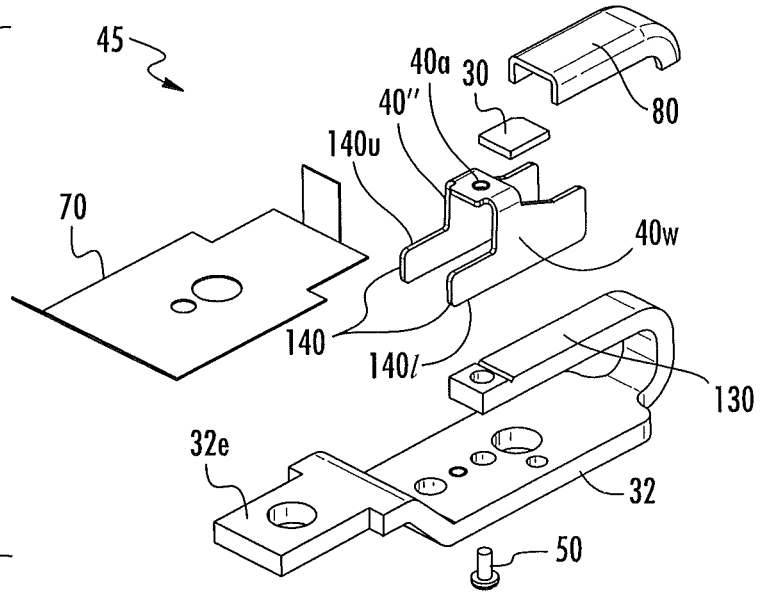
FIG. 8D is an exploded view thereof.
Figure 9A:
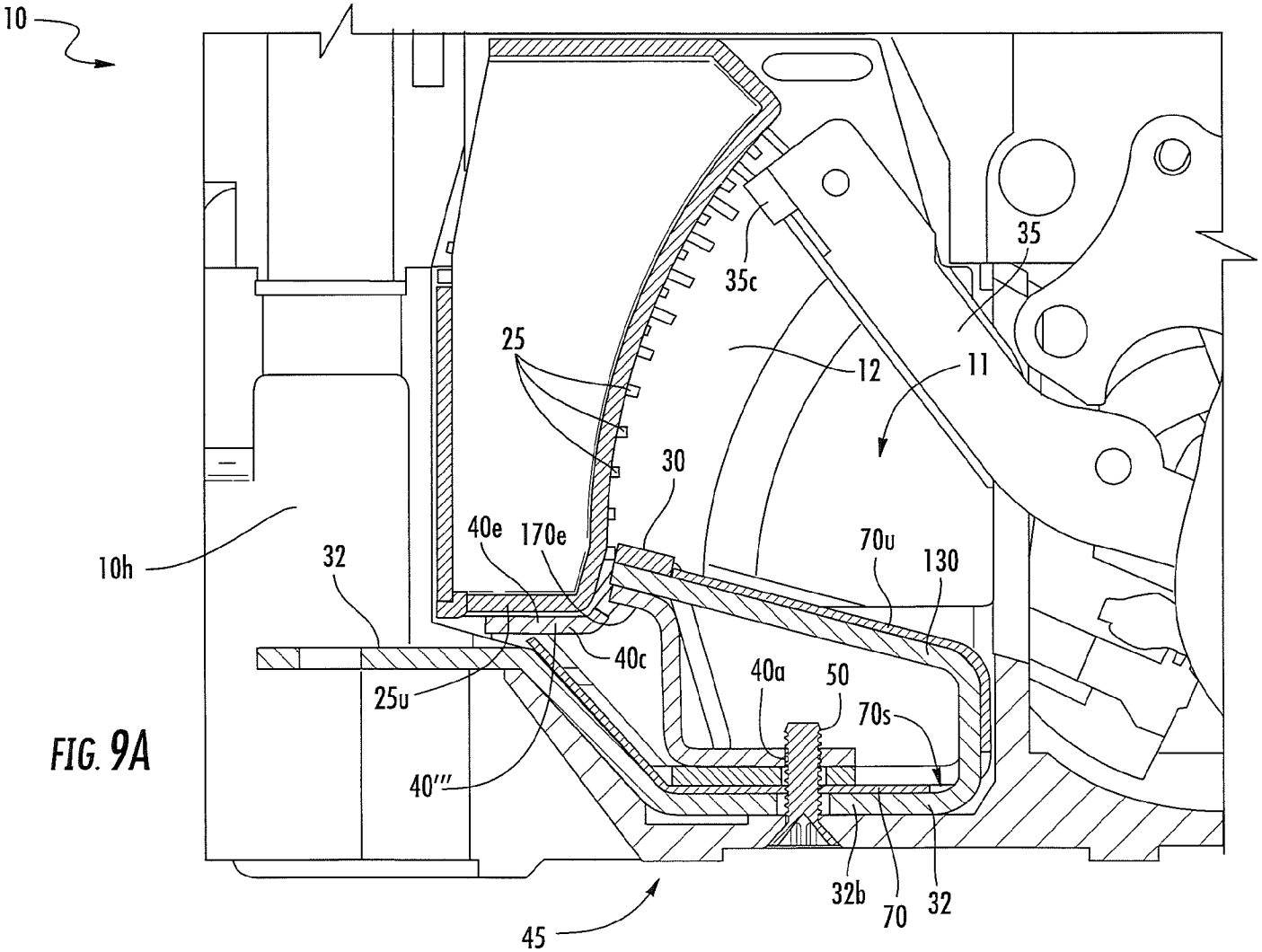
FIG. 9A is an enlarged side, partial cutaway view of a circuit breaker with another exemplary line conductor assembly (shown in FIGS. 10A-10D) according to embodiments of the present invention.
Figure 9B:
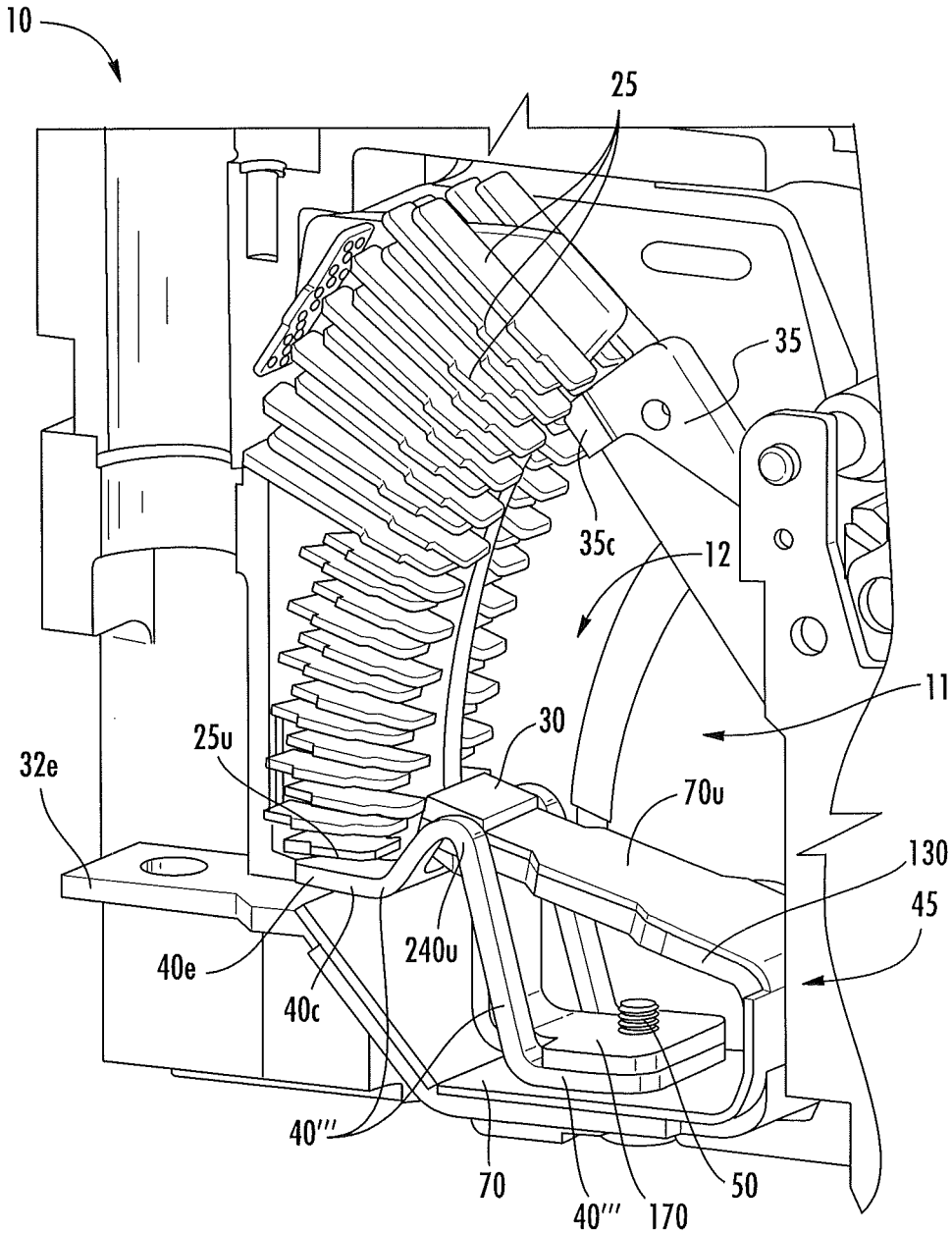
FIG. 9B is an enlarged side perspective, partial cutaway view of the exemplary circuit breaker shown in FIG. 9A according to embodiments of the present invention.

FIGS. 1, 2A-2C, 3 and 4A-4C show the arc runner 40 residing spaced apart and below from the stationary contact 30 attached to the line conductor 32. FIGS. 5A-5C and FIGS. 8A-8D show that the arc runner 40', 40" can be attached to an upper portion 130 of the line conductor 32 and extend down to reside proximate the base portion of the line conductor 32*b*. FIGS. 5A-5C and 6A show the arc runner 40' spaced apart above the base portion of the line conductor 32*b* with an air gap therebetween having a sufficient distance to allow visual access to the attachment member 50 residing between the walls 40*w*. FIGS. 7B and 8C show the arc runner 40" can be closely spaced above the lower portion or primary body of the line conductor 32*b*. FIGS. 9A, 9B, 10A and 10B show the arc runner 40''' can be attached to only the bottom portion of body of the line conductor 32*b*. Both free ends of the arc runner 40*e* and line conductor support 170*e* can face the stack of arc plates 25.

The reverse loop cover 80 (where used) and line conductor cover 70 are non-conductive. The covers can comprise "fish paper", CFM and/or glass filled polyester or other suitable non-conductive and/or electrical insulation material. In some embodiments, the attachment member 50 and the line conductor 32 are non-ferromagnetic conductive members. The line conductor 32 can comprise copper, a suitable grade stainless steel or any suitable non-ferromagnetic material. The contact 30 is conductive, typically a silver alloy. The mating parts for the above, e.g., the moving contact 35*c* and moving arm 35 can comprise the same materials, e.g., silver alloy (for the contact 35*c*) and copper, respectively. It is also contemplated that the line conductor cover 70, and reverse loop cover (where used), can be formed using a non-conductive insulator material which can be applied as a sheet of material, an adhesive, film, ceramic or polymer material.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. A circuit breaker, comprising:

an arc chamber;

an arc chute comprising a plurality of arc plates in the arc chamber;

a line conductor in the arc chamber, the line conductor having a lower body portion and an upwardly extending arm with a free end, the arm residing above the lower body portion;

a stationary contact held by the arm of the line conductor, the stationary contact residing adjacent to the arc plates; and a non-ferromagnetic arc runner held by the line conductor in the arc chamber, wherein the arc runner is at least one of (a) attached to the lower body portion of the line conductor and resides forward of the stationary contact with a portion residing under a bottom arc plate so the portion of the arc runner residing under the bottom arc plate has a surface opposed to a bottom surface of the bottom arc plate or (b) attached to the arm of the line conductor and resides at least partially on a substantially common plane as the stationary contact with at least one downwardly extending sidewall that extends down toward the lower body portion of the line conductor a distance forward of and under the stationary contact with a portion residing under a bottom arc plate, whereby the arc runner defines an arc path that leads to an underside of one or more of the lower arc plates.

2. The circuit breaker of claim 1, wherein the arc runner has forward facing spaced apart segments defining a gap space therebetween.

3. The circuit breaker of claim 1, wherein the arc runner has a pair of spaced apart fingers that are planar and substantially horizontally oriented.

4. The circuit breaker of claim 1, wherein the arc runner has a pair of spaced apart substantially vertically extending sidewalls.

5. The circuit breaker of claim 1, further comprising a non-conductive line conductor cover residing over an upper surface of the lower portion of the line conductor.

6. The circuit breaker of claim 1, wherein the arc runner is attached to the lower body portion and has curved shape with upper and lower substantially parallel segments, the upper segment having a free end that faces the arc plates and resides a distance under the arm of the line conductor, and wherein the lower segment resides adjacent the lower body portion of the line conductor and spaced apart below the line conductor arm.

7. The circuit breaker of claim 1, wherein the arc runner is attached to the lower body portion of the line conductor and has a body with legs that rise up to a location above or proximate the arm of the line conductor proximate the stationary conductor, then travel down to a forward planar segment that resides under the bottom arc plate.

8. The circuit breaker of claim 7, further comprising a line conductor cover with a lower wall that merges into an upper arm that tapers upward to a free end that terminates before the stationary conductor, wherein the line conductor cover comprises a laterally extending slot sized and configured to slidably receive the arm of the line conductor so that the line conductor arm resides under the line conductor cover arm and the lower portion of the line conductor cover resides above the line conductor lower body portion.

9. The circuit breaker of claim 1, wherein the arc runner is an auxiliary arc runner, the circuit breaker further comprising a stationary arc runner that resides in front of the stationary conductor on the arm of the line conductor.

10. The circuit breaker of claim 1, wherein the arc runner is attached to the line conductor arm and has two spaced apart downwardly extending walls, one residing on each side of the arm and extending a distance forward of the stationary contact.

11. The circuit breaker of claim 1, further comprising a reverse loop cover residing on the arm of the line conductor spaced apart from the stationary contact and away from the free end of the line conductor.

12. The circuit breaker of claim 1, wherein the arc runner is an auxiliary arc runner that is attached to the line conductor arm, the circuit breaker further comprising a stationary arc runner that resides in front of the stationary conductor on the arm of the line conductor and a line conductor cover residing on the lower body portion of the line conductor, wherein the auxiliary arc runner has two spaced apart downwardly extending walls with lower ends residing above the line conductor lower body with a gap space therebetween, one wall residing on each side of the line conductor arm with outwardly extending narrow fingers on the forward ends thereof.

13. The circuit breaker of claim 1, further comprising a line conductor cover residing on the lower body portion of the line conductor, wherein the arc runner has two spaced apart downwardly extending walls with lower edges residing proximate the line conductor cover, one residing on each side of the line conductor arm with outwardly extending downwardly and outwardly extending substantially planar fingers on the forward ends.

14. The circuit breaker of claim 1, wherein the arc runner has a forward end portion with fingers having a gap space therebetween that reside a one on each side of the stationary contact.

15. The circuit breaker of claim 14, wherein the gap space has a width that is greater than a width of the stationary contact and/or adjacent arc plate residing between the fingers in the gap space.

16. The circuit breaker of claim 1, further comprising a line conductor cover residing on the lower body portion of the line conductor, wherein the arc runner, line conductor and line conductor cover each comprise at least one aligned aperture that receives an attachment member that attaches the arc runner to the line conductor.

17. An arc chamber assembly, comprising:

an arc chamber having a molded body;

an arc chute comprising a plurality of arc plates in the arc chamber;

a movable arm holding a movable contact in the arc chamber;

a line conductor assembly held in the arc chamber adjacent a portion of the arc chute, the line conductor assembly comprising a line conductor having a lower body portion and an upwardly extending arm with a free end, the arm residing above the lower body portion, a stationary contact held by the line conductor that cooperates with the movable contact and a non-ferromagnetic arc runner attached to the line conductor residing in the arc chamber, wherein the arc runner is at least one of (a) attached to the lower body portion of the line conductor and resides forward of the stationary contact with a portion residing under a bottom arc plate so that the portion of the arc runner residing under the bottom arc plate has a surface opposed to a bottom surface of the bottom arc plate or (b) attached to the arm of the line conductor and resides on a substantially common plane as the stationary contact with at least one downwardly extending sidewall that extends down toward the lower body portion of the line conductor a distance forward of the stationary contact with a portion residing under a bottom arc plate, whereby the arc runner defines an arc path that leads to an underside of a bottom arc plate; and a non-conductive line conductor cover residing over the line conductor lower body portion.

18. A line conductor assembly, comprising:

an elongate line conductor having a lower body portion and an upwardly extending arm, the line conductor holding a stationary electrical contact on a forward end portion of the arm for a direct current (DC) circuit breaker;

a non-ferromagnetic, conductive arc runner attached to the elongate line conductor, wherein the arc runner has forward extending segments that define a gap space therebetween, the segments sized and configured to reside on opposing lateral sides of the line conductor and/or stationary contact; and a non-conductive line conductor cover residing over the line conductor lower body portion.

19. The assembly of claim 18, wherein the spaced apart segments are fingers that extend down from the line conductor arm or that extend up from the lower body portion of the line conductor and face the arc plates.

20. The assembly of claim 18, wherein the spaced apart segments are upper portions of legs that rise up from the lower body portion of the line conductor then travel down toward a front planar end of the arc runner.

21. The assembly of claim 18, wherein the arc runner is a first arc runner, the assembly further comprising a second arc runner that is held by the arm of the line conductor.

22. A method of directing arcs in an arc chute of a bidirectional direct current circuit breaker, comprising:

providing a circuit breaker with an arc chamber comprising an arc chute with arc plates and a line conductor with a stationary conductor and least one arc runner; and directing an electrical arc to travel along an arc path that extends to an underside of a bottom arc plate of the arc chute inward of an outer edge of the bottom arc plate using the arc runner.

* * * * *